US009364103B2

(12) United States Patent
Crabtree, II

(10) Patent No.: US 9,364,103 B2
(45) Date of Patent: Jun. 14, 2016

(54) SHELVING SYSTEM

(71) Applicant: Phillip C. Crabtree, II, Owensboro, KY (US)

(72) Inventor: Phillip C. Crabtree, II, Owensboro, KY (US)

( * ) Notice: Subject to any disclaimer, the term of this patent is extended or adjusted under 35 U.S.C. 154(b) by 0 days.

(21) Appl. No.: 14/313,383

(22) Filed: Jun. 24, 2014

(65) Prior Publication Data

US 2014/0374368 A1 Dec. 25, 2014

Related U.S. Application Data

(60) Provisional application No. 61/839,148, filed on Jun. 25, 2013.

(51) Int. Cl.
*A47F 5/00* (2006.01)
*A47B 57/58* (2006.01)

(52) U.S. Cl.
CPC ..... *A47F 5/005* (2013.01); *A47B 57/58* (2013.01)

(58) Field of Classification Search
CPC ..... A47F 5/005; A47B 57/58; A47B 57/583
USPC ..... 211/184, 42, 43, 119.003; 108/60, 61; 312/140.4; 220/532, 533, 529
See application file for complete search history.

(56) References Cited

U.S. PATENT DOCUMENTS 355,511 A * 1/1887 Danner ..... 108/61
575,294 A * 1/1897 Borden ..... 211/184
712,936 A * 11/1902 Jones ..... 211/184
767,037 A * 8/1904 Brett ..... 108/61
995,410 A * 6/1911 McClure ..... 312/137
1,231,005 A * 6/1917 Erickson ..... 211/184
1,675,269 A * 6/1928 Hine ..... 108/61
1,806,642 A * 5/1931 Ohnstrand ..... 108/61
2,529,826 A * 11/1950 Walker ..... 312/140
2,539,335 A * 1/1951 Smith ..... 312/140.4
2,884,139 A * 4/1959 Dunham ..... 211/184
2,915,193 A * 12/1959 Bromberg ..... 108/61
3,285,429 A * 11/1966 Propst ..... 211/184
3,391,793 A * 7/1968 Streuli ..... 211/43
3,830,169 A * 8/1974 Madey ..... 108/61
3,872,976 A * 3/1975 Moore et al. ..... 211/184
4,327,838 A * 5/1982 Cooke ..... 211/184
4,476,985 A * 10/1984 Norberg et al. ..... 211/133.6
4,641,897 A * 2/1987 Long et al. ..... 312/183
4,750,625 A * 6/1988 Frederick ..... 211/184
4,759,449 A * 7/1988 Gold ..... 211/43
4,841,878 A * 6/1989 Kriegsman ..... 108/90
5,052,580 A * 10/1991 Khoury ..... 220/505
5,078,280 A * 1/1992 Nordeen ..... 211/119.003
D331,599 S * 12/1992 Lushington et al. ..... D19/32
5,217,124 A * 6/1993 Stone ..... 211/184
5,275,297 A * 1/1994 Dokoupil et al. ..... 211/184
5,474,190 A * 12/1995 Won-Kim ..... 211/41.12
5,664,691 A * 9/1997 Boivin-Paradis ..... 211/184

(Continued)

*Primary Examiner* — Joshua J Michener
*Assistant Examiner* — Devin Barnett
(74) *Attorney, Agent, or Firm* — Woodard, Emhardt, Moriarty, McNett & Henry LLP

(57) ABSTRACT

A shelving system attachable to a shelf to provide one or more storage areas on the shelf. The shelving system includes a shelf assembly configured for attachment to the shelf and one or more divider walls configured for attachment to both the shelf assembly and the shelf. Each of the divider walls is separated a distance from another of the divider walls to provide a storage area therebetween on the shelf. A variety of differently sized divider walls can be used with the shelving system.

16 Claims, 4 Drawing Sheets

(56) References Cited

U.S. PATENT DOCUMENTS

| | | | | |
|---|---|---|---|---|
| 6,343,454 | B1 * | 2/2002 | Fisher | 52/782.2 |
| 6,471,081 | B1 * | 10/2002 | Weiler | 211/184 |
| D476,375 | S * | 6/2003 | Zadak et al. | D20/43 |
| 6,598,754 | B2 * | 7/2003 | Weiler | 211/184 |
| 7,188,817 | B2 * | 3/2007 | Henning | 248/346.02 |
| D569,141 | S * | 5/2008 | Tobias | D6/509 |
| 7,584,861 | B2 * | 9/2009 | Werner | 211/64 |
| 8,104,630 | B2 * | 1/2012 | Schneider | 211/184 |
| 8,517,191 | B2 * | 8/2013 | Paeth | 211/184 |
| 8,556,092 | B2 * | 10/2013 | Valiulis et al. | 211/184 |
| 8,763,819 | B2 * | 7/2014 | Theisen et al. | 211/71.01 |
| 2003/0029824 | A1 * | 2/2003 | Weiler | 211/184 |
| 2003/0146357 | A1 * | 8/2003 | Bjerke et al. | 248/220.22 |
| 2004/0011754 | A1 * | 1/2004 | Zadak | 211/184 |
| 2005/0224437 | A1 * | 10/2005 | Lee | 211/184 |
| 2006/0049125 | A1 * | 3/2006 | Stowell | 211/184 |
| 2006/0180056 | A1 * | 8/2006 | Dorholt | 108/90 |
| 2007/0245611 | A1 * | 10/2007 | McDonald | 40/661.03 |
| 2010/0252519 | A1 * | 10/2010 | Hanners et al. | 211/184 |
| 2012/0097629 | A1 * | 4/2012 | Brisendine | 211/96 |
| 2012/0285915 | A1 * | 11/2012 | O'Quinn et al. | 211/134 |
| 2013/0020270 | A1 * | 1/2013 | Valiulis et al. | 211/59.2 |

* cited by examiner

SHELVING SYSTEM

CROSS-REFERENCE TO RELATED APPLICATION

This application claims the benefit of U.S. Provisional Application No. 61/839,148 filed Jun. 25, 2013, which is hereby incorporated by reference.

BACKGROUND

The present invention relates generally to a shelving system and, more particularly, to a divider wall that is removably coupled to a shelf assembly.

Shelving is used for stocking and storing products or merchandise in a variety of stores, offices, hospitals, or other settings. In most of these settings, many different types of products are displayed on a single shelf. Over time as each of the products is accessed by a person, often the various products become disorganized or mixed up. It is difficult and time consuming to organize and maintain separation of the different types of products on a single shelf.

In one particular setting, such as a hospital or medical facility setting, there are additional concerns. Typically, various items are stored on a single shelf that must be dispensed to patients on a regular basis by nurses or other medical personnel. For example, personal hygiene products such as shampoo, hair conditioner, soap, lotion, toothpaste, and toothbrushes, to name a few items, are stored in small bottles or tubes on a shelf. After a period of time, these products become disorganized on the shelf and medical personnel waste much time searching for these items. Similarly, and more critically, medical devices or equipment and pharmaceuticals are stored on a shelf and can become disorganized causing medical personal to waste time searching for the appropriate item.

Waste of time by medical personal when dispensing disorganized products increases healthcare costs. Moreover, many hospitals and medical facilities do not have the funds to buy new storage systems that organize the products better than an open shelf; instead, there is a need to retrofit an existing shelf to separate and organize these items. Retrofitting an existing shelf typically requires a storage system that attaches to a shelf via mechanical fasteners. Holes are drilled into the shelf and wall dividers are connected thereto with mechanical fasteners. Unfortunately, bacteria, such as staph, or other germs can form in the holes in the shelf and the dividers and/or the fasteners causing a serious health risk to patients and medical personnel. To adjust the location of a divider relative to the shelf, a new hole must be drilled into the shelf to attach the divider to the shelf.

Thus, there is a need for improvement in this field.

DESCRIPTION OF THE SELECTED EMBODIMENTS

Figure 1:
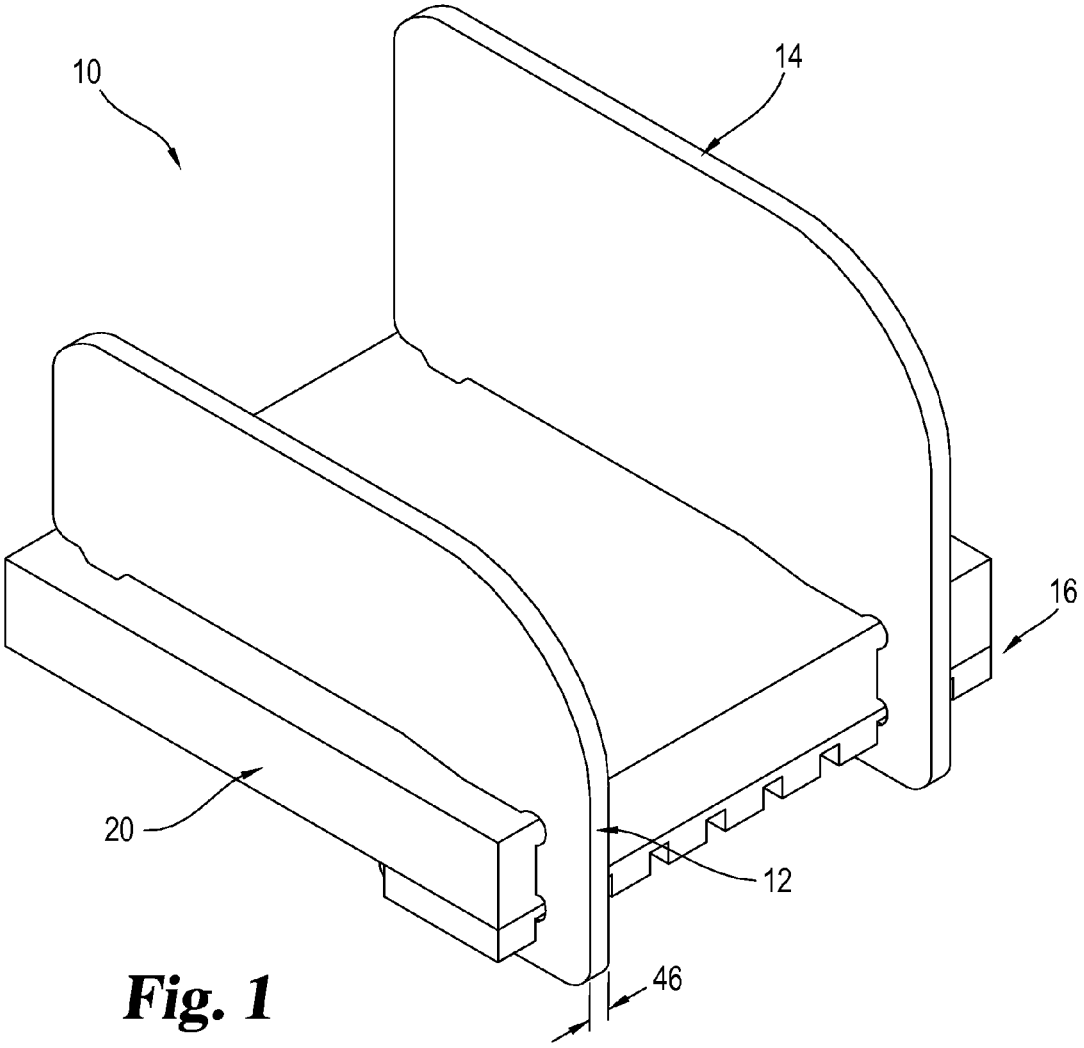
FIG. 1 is a front perspective view of a shelving system according to one embodiment of the present invention.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Depicted in FIG. 1 is a shelving system 10 according to one embodiment of the present invention. In this embodiment, the shelving system 10 includes a first divider wall 12, a second divider wall 14, and a shelf assembly 16 configured to receive and retain the first divider wall 12 and the second divider wall 14. Other embodiments include a different number of first divider walls 12 or second divider walls 14 or a single type of either first divider wall 12 or second divider wall 14. Other configurations for a divider wall are described throughout the application and can be used with the shelving system 10. In this embodiment, the shelving system 10 is mounted or attached to a shelf 20.

Figure 2:
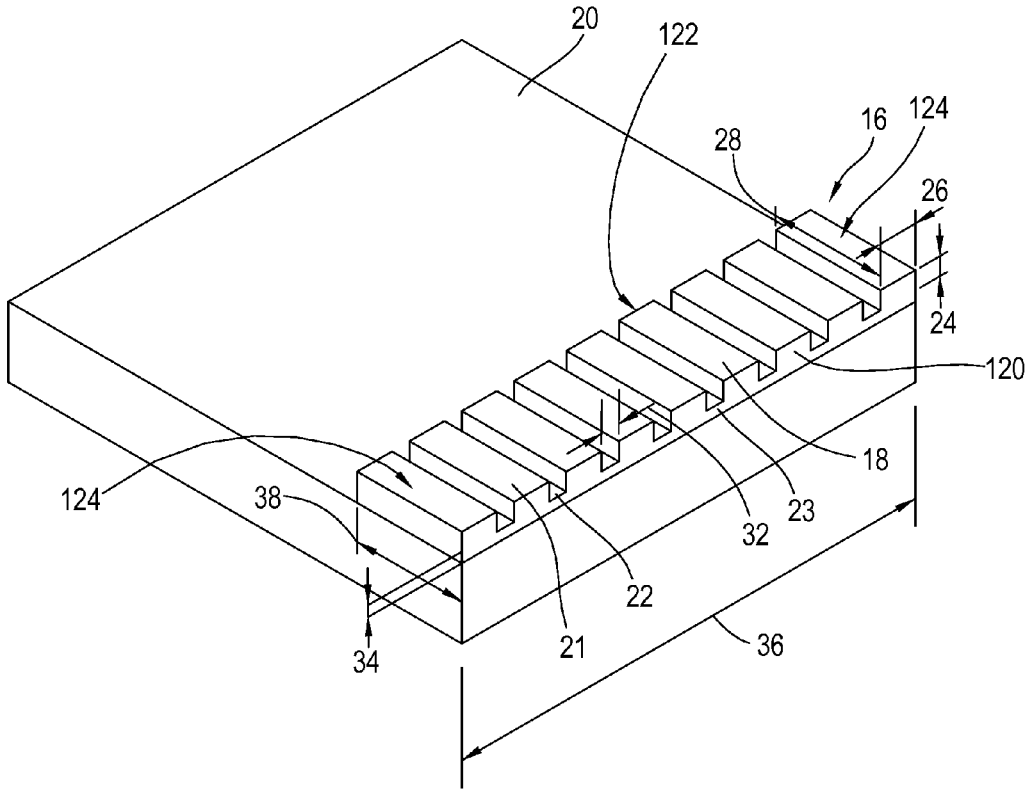
FIG. 2 is a bottom perspective view of a shelf assembly of the shelving system from the embodiment in FIG. 1.

Depicted in FIG. 2 is the shelf assembly 16 that includes a shelf attachment 18 and a shelf platform 23 that are configured for attachment to the shelf 20 and are shown mounted on the shelf 20. In the illustrated embodiment, the shelf attachment 18 and the shelf platform 23 are shown as a monolithic piece; however, in other embodiments the shelf attachment 18 is attached to the shelf platform 23. The shelf assembly 16 includes a front end 120 opposite a rear end 122 and a pair of side edges 124 that span between the front and rear ends 120 and 122, respectively. In the illustrated embodiment, the shelf assembly 16 is mounted on the shelf 20 such that the front end 120 of the shelf assembly 16 is flush or aligned with a front edge of the shelf 20. In other embodiments, the shelf assembly 16 is positioned a distance from the front edge of the shelf 20.

The shelf attachment 18 includes a plurality of support bars 21 alternating with a plurality of slots 22 that span across a width 36 of the shelf platform 23. Each of the support bars 21 has a height 24, a width 26, and a length 28. In the illustrated embodiment, the height 24 of each of the support bars 21 is the same. In the illustrated embodiment, the width 26 of each of the support bars 21 is the same, and the length 28 of each of the support bars 21 is the same. In other embodiments, the height 24, the width 26, and/or the length 28 can vary for each of the support bars 21 as desired. Each of the slots 22 has a width 32 that corresponds to a thickness of the first divider wall 12 or the second divider wall 14. In the illustrated embodiment, the width 32 of each of the slots 22 is the same; however, in other embodiments the width 32 of each of the slots 22 can be different to accommodate the thickness of the corresponding divider wall 12 or 14 that connects to that particular slot 22. As such, the width 32 of the slots 22 and the width 26 of the support bars 21 are varied and arranged to customize a particular layout and/or size of divider walls 12 and 14. As can be appreciated, the depth of the slots 22 corresponds to the height 24 of the adjacent support bar 21.

In this embodiment illustrated in FIG. 2, the shelf platform 23 has a height 34, a width 36, and a length 38. The height 34 of the shelf platform 23 is constant and is relative to the overall distance between a horizontal portion 62 and a ramp portion 74 of the first divider wall 12 less a thickness of the shelf 20 as described in more detail below (see FIG. 3). The width 36 of the shelf platform 23 is the same as the total width of all of the support bars 21 and the slots 22. In other embodiments, the width 36 of the shelf platform 23 can extend beyond the outermost support bar 21 of the plurality of support bars 21 to form a lip or overhang. In this embodiment, the length 38 of the shelf platform 23 is the same as the length 28 of the support bars 21. In other embodiments, the length 38 of the shelf platform 23 is longer than the length 28 of the support bars 21 to form a lip or overhang on either or both of the front or read ends of the support bars 21.

Figure 3:
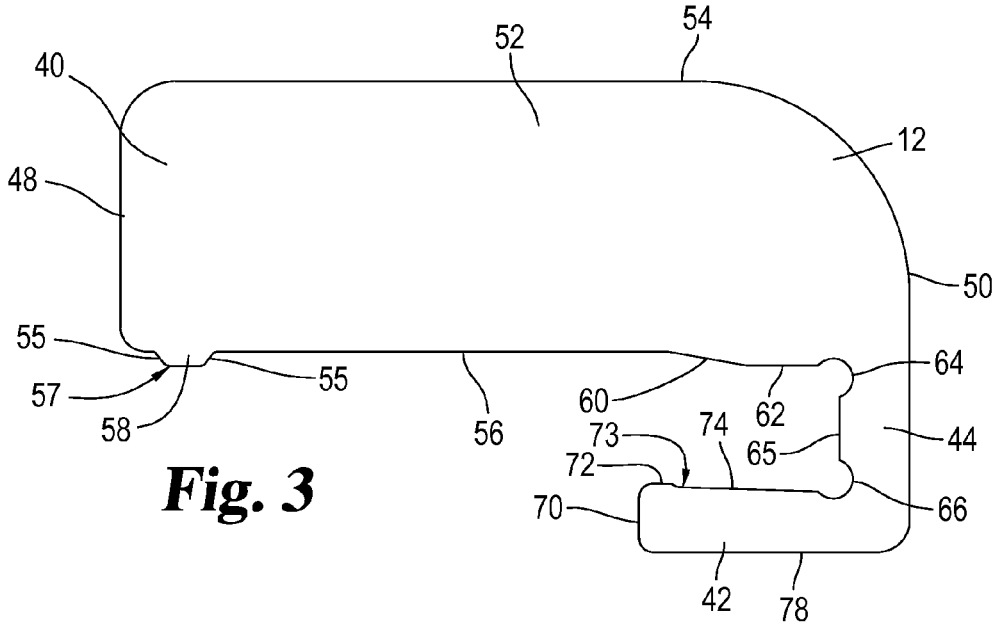
FIG. 3 is a side view of a first divider wall of the shelving system in FIG. 1.

Depicted in FIG. 3 is first divider wall 12. First divider wall 12 includes an upper wall portion 40, a leg portion 42, and a middle portion 44 that spans between the upper wall portion 40 and the leg portion 42. The first divider wall 12 has a thickness 46 (illustrated in FIG. 1) that is about the same as or slightly less than the width 32 of one of the slots 22 such that first divider wall 12 can be inserted into one of the slots 22. In one embodiment, a horizontal portion 62 of the first divider wall 12 has a thickness that is the same as or slightly less than the width 32 of one of the slots 22. The remainder of the first divider wall 12 can have the same thickness as the horizontal portion 62 or can be thicker or thinner as desired.

The upper wall portion 40 has a first end 48 opposite a second end 50 and a body portion 52 that spans between the first end 48 and the second end 50. Upper wall portion 40 has a top edge 54 opposite a bottom edge 56 with a height spanning between the top edge 54 and the bottom edge 56. The height of the upper wall portion 40 is configured to adequately separate the items placed on the shelf 20 adjacent the first divider wall 12 when the first divider wall 12 is connected to the shelf assembly 16 and the shelf 20, as described below. As such, when a plurality of first divider walls 12 are assembled with the shelf assembly 16 and shelf 20, there is a storage area created between a pair of divider walls 12 on the shelf 20. As can be appreciated, each storage area can be sized differently depending on the arrangement of the divider walls 12. In the illustrated embodiment, the bottom edge 56 includes a first protrusion 58 near the first end 48. The first protrusion 58 can have various configurations to rest on shelf 20 when the first divider wall 12 is assembled with the shelf 20. In the illustrated embodiment, first protrusion 58 has a generally trapezoid shape with a pair of tapered edges 55 that span from the bottom edge 56 to a contact edge 57 that is generally parallel with the bottom edge 56. In other embodiments, the bottom edge 56 does not include the first protrusion 58 such that the bottom edge 56 rests directly on the shelf 20 when the first divider wall 12 is assembled therewith. The bottom edge 56 also includes a tapered portion 60 and a horizontal portion 62 that align with the leg portion 42 such that the tapered portion 60 and the horizontal portion 62 are offset from leg portion 42 by the middle portion 44. Both contact edge 57 and horizontal portion 62 are substantially horizontal when the first divider wall 12 is assembled with the shelf assembly 16 and the shelf 20. In one form, the contact edge 57 and the horizontal portion 62 are in the same horizontal plane. The upper wall portion 40 has a substantially rectangular shape with rounded corners; however, in other embodiments upper wall portion 40 has a different shape. In other embodiments, the upper wall portion 40 may include one or more holes near the second end 50 for engagement by a hand of a person or mechanical device to assist with installation of the divider wall 12 with the shelf assembly 16 and shelf 20.

Middle portion 44 has a first relief slot 64 and a second relief slot 66 separated by a vertical edge 65 wherein the first relief slot 64, vertical edge 65, and the second relief slot 66 are sized to receive the shelf platform 23 and the shelf 20 when the first divider wall 12 is assembled therewith. In the illustrated embodiment, the first relief slot 64 and the second relief slot 66 each have a semi-circular shape. The first and second relief slots 64 and 66 can be shaped differently in other embodiments. The first and second relief slots 64 and 66 enable the upper wall portion 40, the leg portion 42, and the middle portion 44 to flex or rotate about the relief slots 64 and 66 as the first divider wall 12 is slid onto one of the slots 22 and the shelf 20, as described below.

The leg portion 42 includes an end 70 with a stop portion 72 for retaining the first divider wall 12 on the shelf assembly 16 and the shelf 20. The stop portion 72 includes a lip 73 for engaging the rear end 122 of the shelf assembly 16. The leg portion 42 includes a ramp portion 74 adjacent the stop portion 72 that engages one of slots 22 when the first divider wall 12 is assembled with the shelf assembly 16 and the shelf 20. The ramp portion 74 spans between the second relief slot 66 and the lip 73 and is sized to correspond to the length of the slot 22. The ramp portion 74 is sloped or tapered in an upward direction relative to a bottom edge 78 of the leg portion 42.

Figure 4:
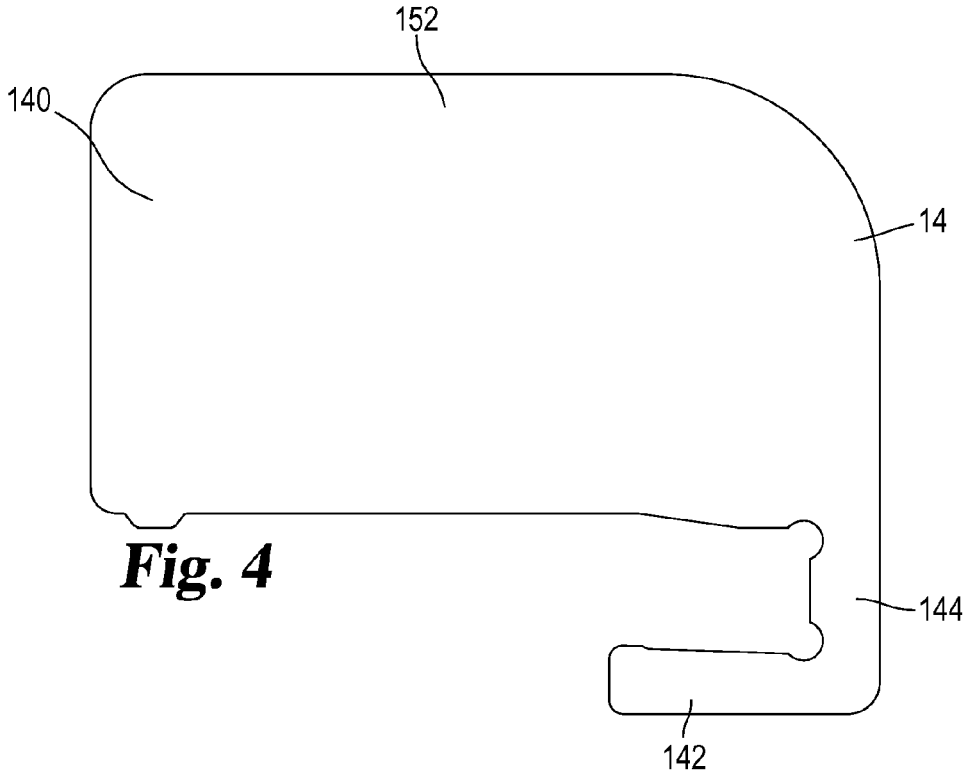
FIG. 4 is a side view of a second divider wall of the shelving system in FIG. 1.

Depicted in FIG. 4 is a second divider wall 14, which is substantially similar to first divider wall 12. However, second divider wall 14 has an upper wall portion 140 that is larger and has a greater height than the upper wall portion 40 of first divider wall 12. In other embodiments, second divider wall 14 has a body portion 152 with a longer length to thereby extend the length of the upper wall portion 140. A middle portion 144 and a leg portion 142, respectively, are substantially similar to middle portion 44 and leg portion 42, respectively, of first divider wall 12.

The first divider wall 12, the second divider wall 14, and the shelf assembly 16 can be made of plastic, poly(methyl methacrylate) (PMMA), or other thermoplastic materials. The shelf assembly 16 is typically attached to the shelf 20 with glue or other adhesive or can be attached by mechanical fasteners.

Figure 5:
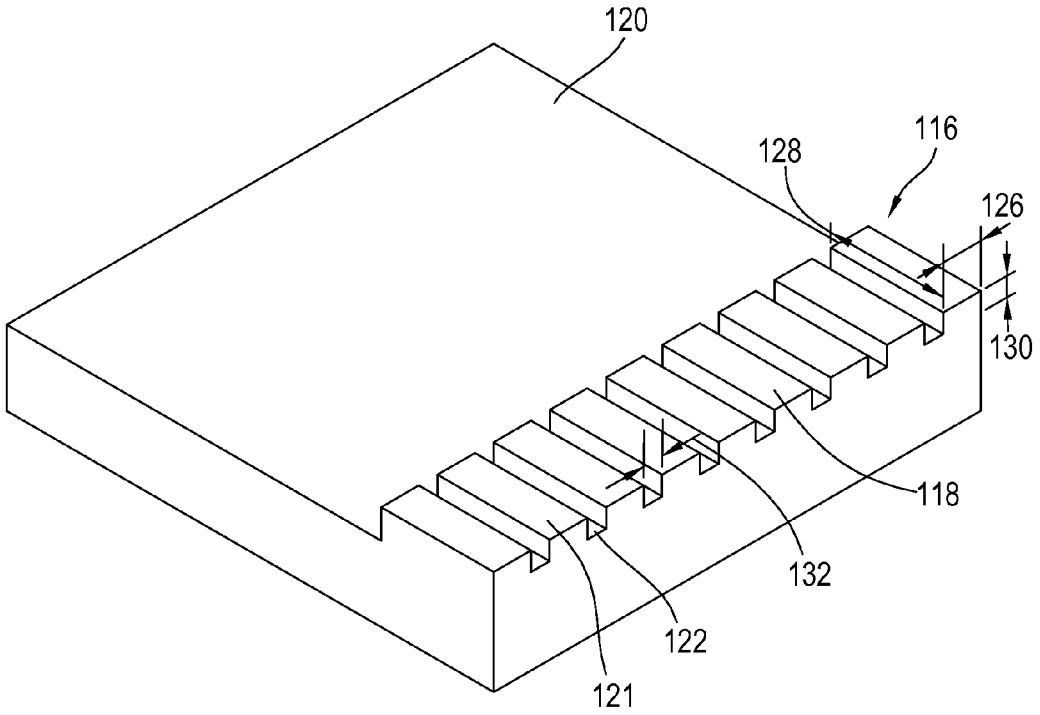
FIG. 5 is a bottom perspective view of a second embodiment of a shelf assembly.

Illustrated in FIG. 5 is a second embodiment of a shelf assembly 116 that is similar to shelf assembly 16 except the shelf assembly 116 includes a shelf attachment 118 that is monolithic with a shelf 120. Shelf assembly 116 includes a plurality of support bars 121 that alternate with a plurality of slots 122 that span across the width of the shelf 120. Each of the support bars 121 has a height 130, a width 126, and a length 128. Each of the slots 122 has a width 132 that corresponds to a thickness of the first or the second divider walls 12 or 14.

Assembly of the first divider wall 12 or the second divider wall 14 to the shelf assembly 16 and the shelf 20 (or to the shelf assembly 116) is substantially the same. Therefore, for the sake of brevity, assembly will be discussed with respect to the first divider wall 12. The end 70 and stop portion 72 of leg portion 42 are aligned with one of the slots 22 of the shelf attachment 18 and the first end 48 and body portion 52 are positioned on the shelf 20. A force is applied to the middle portion 44 to push the ramp portion 74 into the slot 22 and the tapered portion 60 onto the shelf 20. As the leg portion 42 and the tapered portion 60 continue to pass over the shelf attachment 18 and the shelf 20, the leg portion 42 rotates slightly outward at the second relief slot 66 such that the stop portion 72 is pressed against the slot 22 while the horizontal portion 62 rests against the shelf 20. Additionally, the middle portion 44 rotates slightly outward at the first relief slot 64. As the force is continued to be applied to the middle portion 44, the stop portion 72 passes over a rear edge of the slot 22 such that the force on leg portion 42 is released to enable the leg portion 42 to rotate slightly inward. In the position where the leg portion 42 is rotated slightly inward, the ramp portion 74 rests against the slot 22, and both of the horizontal portion 62 and the first protrusion 58 rest against the shelf 20. The distance between the horizontal portion 62 and the ramp portion 74 is slightly less or about the same as the combined thickness of shelf 20 and the depth of the shelf platform 23. Assembly of a plurality of the first divider walls 12 and/or the second divider walls 14 with the shelf assembly 16 and the shelf 20 creates a plurality of storage areas on the shelf 20 for receiving and storing articles, packages, pharmaceuticals, personal hygiene products, or other goods.

To remove the first divider wall 12 from the shelf assembly 16, a pulling force is applied to the middle portion 44. Initially, stop portion 72 resists movement of the first divider wall 12 relative to the shelf assembly 16 until as the pulling force continues to increase the leg portion 42 will rotate outward at and about the second relief slot 66. As the force increases, the upper wall portion 40 and the middle portion 44 also rotate outward at the first relief slot 64, while the stop portion 72 passes over the rear edge of the slot 22. After complete removal of the first divider wall 12 from the shelf assembly 16, the upper wall portion 40 and the middle portion 44 return to their original configuration by rotating slightly inward about the first relief slot 64. The leg portion 42 returns to its original configuration by rotating slightly inward about the second relief slot 66.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A shelving system for a shelf, comprising:

a shelf assembly having a shelf attachment and a shelf platform wherein the shelf platform has a width, a height, and a length, the length of the shelf platform being less than a length of the shelf, and the shelf platform is attachable to the shelf, the shelf attachment having a plurality of support bars and a plurality of slots, wherein the support bars are arranged in an alternating relationship with the slots, each of the plurality of support bars having a width, a height and a length, each of the plurality of slots having a width and a length that span between a front edge and a rear edge, the length of the plurality of slots being less than the length of the shelf; and a plurality of divider walls configured for attachment to both the shelf assembly and the shelf wherein each of the slots of the shelf attachment is sized to receive one of the divider walls between two of the plurality of support bars, each of the divider walls having a leg portion that includes a ramp portion, a stop portion, and a lip, the ramp portion sized to fit in a corresponding one of the plurality of slots to contact the shelf platform, each of the divider walls having the stop portion adjacent the lip, the lip being adjacent the ramp portion wherein the ramp portion is sloped relative to the lip, the stop portion configured to rest against the shelf, the lip configured to engage the rear edge of one of the slots and an end of the shelf platform to retain the divider wall on the shelf assembly and shelf wherein each of the divider walls is separated a distance from another of the divider walls to provide a plurality of storage areas on the shelf, wherein each of the divider walls includes a middle portion that spans between the leg portion and an upper wall portion, a first relief slot having a semi-circular shape that spans between the upper wall portion and the middle portion, and a second relief slot having a semi-circular shape that spans between the middle portion and the leg portion, wherein the upper wall portion, the middle portion, and the leg portion are rotatable about the respective first or second relief slots to enable each of the divider walls to attach to the shelf assembly and the shelf.

2. The shelving system of claim 1, wherein the upper wall portion includes a horizontal portion adjacent the first relief slot, the horizontal portion being positioned opposite the ramp portion, the horizontal portion is configured to rest on a top side of the shelf and the ramp portion is configured to rest in the slot when the plurality of divider walls are assembled with the shelf and the shelf attachment.

3. The shelving system of claim 1, wherein the shelf assembly has a front end opposite a rear end such that the front end is aligned with an edge of the shelf when the shelf assembly is attached to the shelf.

4. The shelving system of claim 1, wherein each of the divider walls includes a vertical edge that spans between the first and the second relief slots such that the vertical edge contacts a front edge of the shelf to limit further movement of the divider wall relative to the shelf assembly and the shelf.

5. A shelving system for a shelf, comprising:

a shelf assembly including a shelf attachment adjacent a shelf platform, the shelf attachment includes a plurality of support bars that alternate with a corresponding plurality of slots, each of the plurality of slots having a width and a length, the length spans between a front edge and a rear edge, the length of the plurality of slots being less than a length of the shelf, the shelf platform has a width, a height, and a length, the length spans from a front edge to a distance away from a rear edge of the shelf such that the length of the shelf platform is less than a length of the shelf, the shelf platform is configured for attachment to the shelf; and a divider wall configured for attachment to the shelf assembly and the shelf wherein one of the slots is sized to receive a leg portion of the divider wall, the leg portion includes a stop portion adjacent a lip, the stop portion configured to contact the shelf, and the lip configured to engage the rear edge of one of the slots and an end of the shelf platform to retain the divider wall on the shelf platform when the divider wall is attached to the shelf assembly, wherein the divider wall includes a middle portion that spans between the leg portion and an upper wall portion, the divider wall includes a first relief slot having a semi-circular shape that spans between the upper wall portion and the middle portion, the divider wall includes a second relief slot having a semi-circular shape that spans between the middle portion and the leg portion, wherein the upper wall portion, the middle portion, and the leg portion are rotatable about the respective first or second relief slots to enable the divider wall to attach to the shelf assembly and the shelf, the middle portion having a vertical edge that spans between the first and the second relief slots such that the vertical edge contacts a front edge of the shelf to limit further movement of the divider wall relative to the shelf assembly and the shelf.

6. The shelving system of claim 5, wherein the upper wall portion includes a horizontal portion adjacent the first relief slot, the horizontal portion is configured to rest on the shelf.

7. The shelving system of claim 5, further comprising:

a second divider wall configured for attachment to the shelf assembly and the shelf wherein one of the slots is sized to receive a leg portion of the second divider wall, wherein the first divider wall is a different size than the second divider wall.

8. A shelving system for a shelf, comprising:

a shelf assembly including a shelf attachment adjacent a shelf platform, the shelf attachment includes a plurality of support bars that alternate with a corresponding plurality of slots, each of the plurality of slots having a length that spans between a front edge and a rear edge, the length of the plurality of slots being less than a length of the shelf, the shelf platform having a height, a length, and a width wherein the length spans from a front edge to a distance offset from the front edge of the shelf such that the length of the shelf platform is less than a length of the shelf, the shelf platform is configured for attachment to the shelf; and a divider wall having a flexible leg portion with a ramp portion sized to fit and rest on a corresponding one of the plurality of slots to contact the shelf platform, the divider wall having a lip adjacent the ramp portion, a stop portion adjacent the lip, wherein the ramp portion is sloped relative to the lip, the stop portion configured to rest against the shelf, the leg portion configured to rotate to attach the divider wall to the shelf assembly and the shelf wherein one of the slots is sized to receive the leg portion, the lip is configured to engage the rear edge of one of the slots and an end of one of the slots, and the stop portion is configured to contact the shelf to retain the divider wall on the shelf platform, wherein the divider wall includes a middle portion that spans between the leg portion and an upper wall portion, the divider wall includes a first relief slot that spans between the upper wall portion and the middle portion, the divider wall includes a second relief slot that spans between the middle portion and the leg portion, wherein the upper wall portion, the middle portion, and the leg portion are rotatable about the respective first or second relief slots to enable the divider wall to attach to the shelf assembly and the shelf.

9. The shelving system of claim 8, wherein the shelf assembly has a front end opposite a rear end such that the front end is aligned with an edge of the shelf when the shelf assembly is attached to the shelf.

10. A shelving system for a shelf, comprising:

a shelf assembly having a shelf platform and a shelf attachment, the shelf platform attachable to the shelf, the shelf platform having a length that spans from a front edge to a rear edge of the shelf platform, the length of the shelf platform being less than a length of the shelf, the shelf attachment having a plurality of support bars and a plurality of slots, wherein the support bars are arranged in an alternating relationship with the slots, each of the plurality of slots having a width and a length that span between the front edge and the rear edge of the shelf platform, the length of the plurality of slots being less than the length of the shelf; and a divider wall having a middle portion that spans between a flexible leg portion and a body portion, wherein the flexible leg portion has a ramp portion sized to fit in and rest against a corresponding one of the plurality of slots to contact the shelf platform, the flexible leg portion has a lip adjacent the ramp portion, the flexible leg portion having a stop portion adjacent the lip, the flexible leg portion configured to rotate to attach the divider wall to the shelf assembly such that the lip is configured to engage both of the rear edge of one of the slots and an end of one of the slots, and the stop portion is configured to contact the shelf to retain the divider wall on the shelf platform, wherein the upper wall portion spans between a first end opposite a second end and a top edge opposite a bottom edge, the upper wall portion having a first protrusion positioned on the bottom edge near the first end, the first protrusion configured to rest on the shelf when the divider wall is assembled with the shelf and the shelf platform, wherein the divider wall has a first relief slot that spans between the upper wall portion and the middle portion, the divider wall having a second relief slot that spans between the middle portion and the leg portion, wherein the upper wall portion, the middle portion, and the leg portion are rotatable about the respective first or second relief slots to enable the divider wall to attach to the shelf assembly and the shelf.

11. The shelving system of claim 10, wherein the ramp portion spans from the first relief slot to the lip, and the ramp portion is sloped relative to the lip.

12. The shelving system of claim 10, wherein the first protrusion has a substantially trapezoidal shape.

13. The shelving system of claim 10, wherein the divider wall has a tapered portion positioned on the bottom edge near the second end, the tapered portion aligned with the stop portion to enable the divider wall to pass onto the shelf and the shelf assembly.

14. The shelving system of claim 13, wherein the divider wall has a horizontal portion positioned between the tapered portion and the second end, the horizontal portion configured to rest against the shelf when the divider wall is assembled with the shelf and the shelf assembly.

15. The shelving system of claim 14, wherein the horizontal portion is aligned with the first protrusion.

16. The shelving system of claim 5, wherein the divider wall has a ramp portion sized to fit in a corresponding one of the plurality of slots to contact the shelf platform, the ramp portion spans from the first relief slot to the lip, wherein the ramp portion is sloped relative to the lip.

* * * * *